US007059787B2

(12) United States Patent
Ozawa

(10) Patent No.: US 7,059,787 B2
(45) Date of Patent: Jun. 13, 2006

(54) MOTOR CONTROL METHOD AND APPARATUS, TIME RECORDER HAVING SAME AND IMPACT TYPE PRINTING APPARATUS

(75) Inventor: Kenji Ozawa, Satte (JP)

(73) Assignee: Seiko Precision, Inc. (JP)

( * ) Notice: Subject to any disclaimer, the term of this patent is extended or adjusted under 35 U.S.C. 154(b) by 0 days.

(21) Appl. No.: 11/027,094

(22) Filed: Dec. 30, 2004

(65) Prior Publication Data

US 2005/0117954 A1 Jun. 2, 2005

Related U.S. Application Data

(62) Division of application No. 10/179,755, filed on Jun. 24, 2002, now Pat. No. 6,857,799, which is a division of application No. 09/577,513, filed on May 24, 2000, now Pat. No. 6,601,513.

(30) Foreign Application Priority Data

May 25, 1999 (JP) ..... 11/145112
May 25, 1999 (JP) ..... 11/145113
May 27, 1999 (JP) ..... 11/147801

(51) Int. Cl.
*B41J 2/22* (2006.01)

(52) U.S. Cl. ..... 400/124.01; 400/124.02; 400/279

(58) Field of Classification Search ..... 400/124.01, 400/124.02, 124.27–124.29, 124.11, 129, 400/130, 93.04–93.06; 101/93.09, 93.15, 101/93.16, 93.28, 93.48, 93
See application file for complete search history.

(56) References Cited

U.S. PATENT DOCUMENTS 4,020,939 A * 5/1977 Quaif et al. ..... 400/322
4,643,596 A * 2/1987 Shimada et al. ..... 400/124.02
4,844,635 A * 7/1989 Malkemes et al. ..... 400/124.04
5,288,157 A * 2/1994 Tanaka ..... 400/279
5,310,270 A * 5/1994 Matsukura ..... 400/124.02
5,385,414 A * 1/1995 Shirotori et al. ..... 400/124.02

* cited by examiner

*Primary Examiner*—Minh Chau
(74) *Attorney, Agent, or Firm*—Schulte Roth & Zabel, LLP; Joel E. Lutzker; Anna Vishev

(57) ABSTRACT

An impact printing apparatus is also disclosed with printing pin actuation timing correction dependent upon scanning speed or platen shape, striking duration timing dependent upon scanning rate, or printing pin actuation timing dependent upon stored shift amounts.

4 Claims, 16 Drawing Sheets

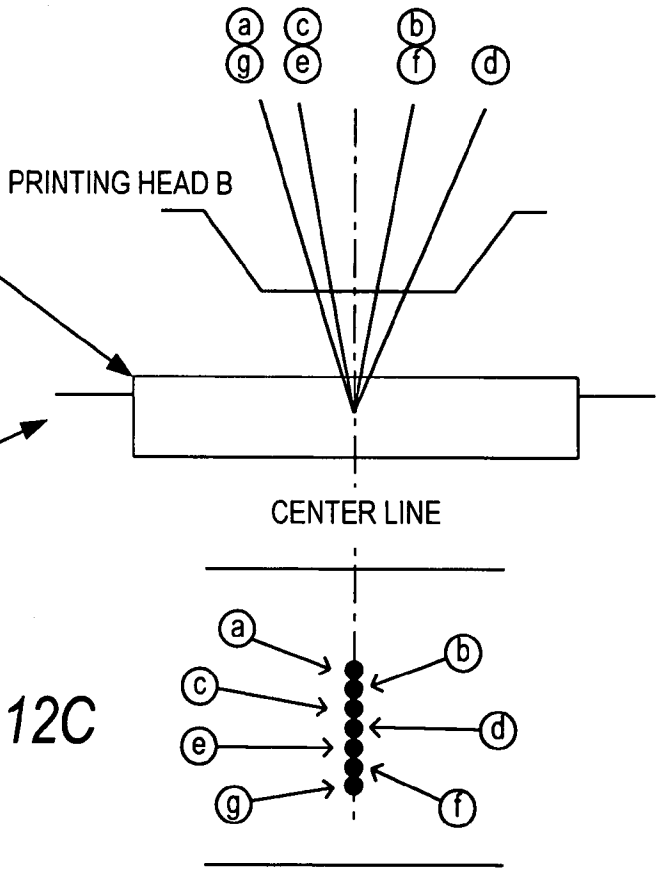
FIG. 12B
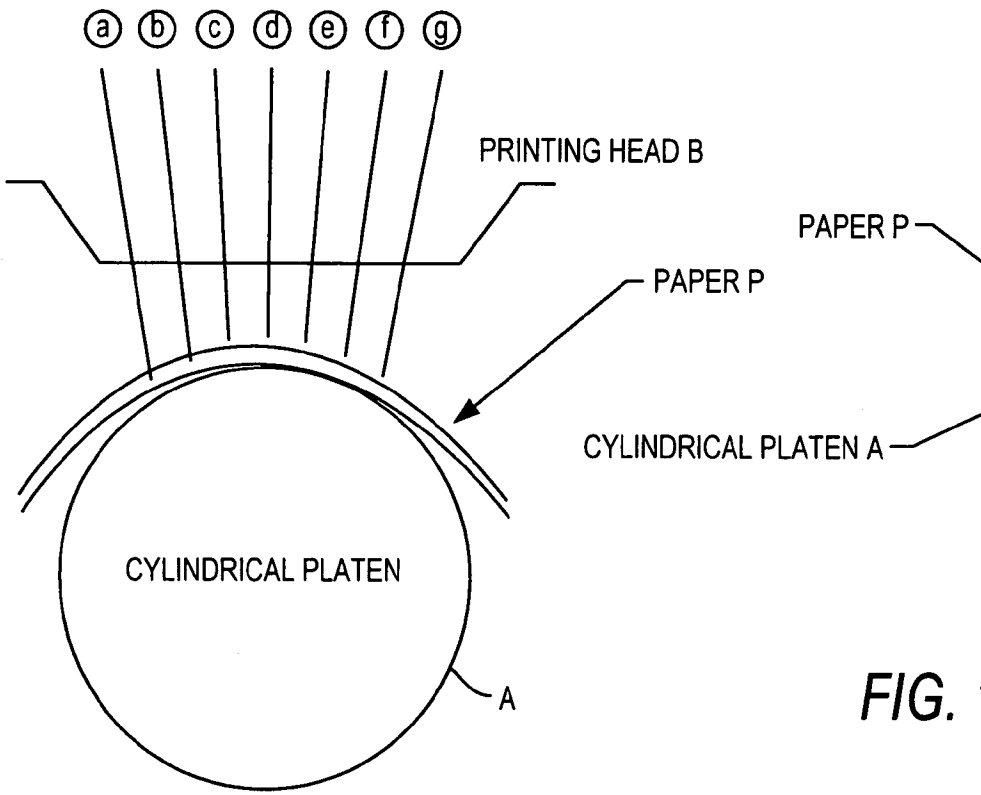
FIG. 12A
FIG. 12C a b c d e f g
PRINTING HEAD B
TIME CARD C
PLANE SHAPE PLATEN D
CYLINDRICAL PLATEN
A a g c e b f d
PRINTING HEAD B
TIME CARD C
PLANE SHAPE PLATEN D
CENTER
TIME CARD a c e g b d f

FIG. 20

| SIGNAL PERIOD OF SENSOR OUTPUT t [μ s] (MOVING SPEED OF CARRIER) | STRIKING DURATION TIME PERIOD OF PRINTING PIN POt [μ s] |
|---|---|
| 732~792 | 366 |
| 793~853 | 427 |
| 854~914 | 442 |
| 915~975 | 442 |
| 976~1036 | 534 |
| 1037~1097 | 595 |
| 1098~1158 | 656 |
| 1159~1219 | 717 |
| 1220~1280 | 725 |
| 1281~1341 | 725 |
| 1342~1402 | 725 |
| 1403~1463 | 725 |
| 1464~1524 | 725 |
| 1525~1585 | 725 |
| 1586~1646 | 725 |
| 1647~ | 725 |

MOTOR CONTROL METHOD AND APPARATUS, TIME RECORDER HAVING SAME AND IMPACT TYPE PRINTING APPARATUS

CROSS REFERENCE TO RELATED APPLICATIONS

This application is a divisional of application Ser. No. 10/179,755, filed Jun. 24, 2002 now U.S. Pat. No. 6,857,799. Application Ser. No. 10/179,755 is a divisional of application Ser. No. 09/577,513, filed May 24, 2000 now U.S. Pat. No. 6,601,513. Application Ser. No. 09/577,513 claims priority from Japanese Patent Application No. 11-145112, filed May 25, 1999, Japanese Patent Application No. 11-145113, filed May 25, 1999, and Japanese Patent Application No. 11-147801, filed May 27, 1999.

FIELD OF THE INVENTION

The present invention relates to a motor control method and apparatus, a time recorder having the motor control apparatus and an impact-type printing apparatus.

BACKGROUND OF THE INVENTION

Conventional card printing devices, such as many time recorders or "punch clocks", employ an inexpensive direct current motor as a means for drawing in a time card and pulling it to the correct position for printing in a printing column, for example.

In the case of a time recorder, when a time card is inserted into a card insertion inlet, the card is detected by a sensor, triggering the motor that draws the card in, relative to a printing means, to a position that corresponds with the current date. The card is then stopped and printed by a printing head.

Precise control of the card stopping position is critical to ensure that the card is properly printed. In the prior art this has been accomplished by braking by applying voltage in the reverse direction to the motor when the card is a predetermined distance away from the target position thereby rapidly decelerating the forward movement of the card, bringing it, theoretically, to a stop at the target position.

However, the control method employed by the prior art has several shortcomings. When the electrical current applied to the card drive motor is abruptly reversed, enormous stresses exerted on the motor deteriorate its durability. Furthermore, calculation of a precise stopping distance of the card is inherently inexact, particularly at high card speeds because it is difficult to predict the stopping position of the direct current motor used to move the card. This is a problem shared in common by any system employing a direct current motor requiring an accurate stop position from a high operating speed.

Therefore, in order to resolve some of these problems, applicant has proposed in Japanese Patent Application No. 9-316824 stop control which is accomplished through an intermediate reduction in the speed of the card drive motor. The card drive motor is initially operated at a high speed until the card is relatively close to the target position, and then switched to a lower speed allowing the card to decelerate to a lower speed, from which it is easier to stop accurately. The rotational speed of a DC motor used as a card drive motor is detected while drawing in a card at a high speed. The time required to stop the card is calculated from that speed, and the timing of the switch from high to low speed drive is adjusted accordingly.

In practice however, this approach is imperfect. In order to reduce the time it takes to feed a card, the card drive motor must operate at a high speed for as long as possible during the feeding of the card. As shown in FIG. 5, extending high speed drive until just prior to the point at which the card must be stopped does not leave sufficient time for the card to decelerate on its own to a stabilized velocity equal to that of the low speed drive. This means that the card must be abruptly stopped from some speed higher than that defined by the low speed drive, causing enormous stresses to the motor during braking causing deterioration of the motor and reducing the accuracy of the calculated stop position.

Furthermore, as shown in FIG. 6, switching to low speed drive sufficiently early in the feeding of the card to allow it to be stabilized at equilibrium with the low speed drive increases card feed time, reducing performance. These problems arise not only for motors for time recorders but for any direct current motor requiring an accurate stop position in a short period of time.

Motor control presents a similar problem when applied to a printing apparatus such as that found in a time recorder. Prior art impact printing systems have used stepping motors, making print head feed control easy to carry out, but relatively expensive. Direct current motors, have also been used, subject to the limitation that the scanning speed of the print head is likely to vary, affecting print quality. For example, if the drive is running on a partially discharged battery, scanning speed may fall. Attempts to compensate for this by speeding up the direct current motor are likely to result in transient overspeed, also degrading print quality as described above. Employing a variable voltage driver circuit to stabilize scanning is another expensive solution. An impact print head found in existing time recorders or "dot-matrix" printers requires a relatively constant scanning speed to ensure proper timing in the actuation of the impact pins. This is exacerbated by expected variations in machining accuracy of existing head scanning mechanisms and the operational environments in which they are used.

When the moving speed of the printing head is accelerated the striking duration of the printing pin is restricted and print darkness is deteriorated. Therefore, in order to prevent the printing darkness from being deteriorated, it is necessary to set a sufficient striking duration by retarding the speed of the printing head.

As shown in FIG. 18, the speed of a moving impact print head, as measured by the output signal of a sensor for detecting rotation of the driving motor, is fixed so that there is sufficient time for the impact pins to be turned "on" during which each impact pin extends from its rest position to make a printing impact, and also for the impact pins to be turned "off" during which each pin is retracted and returned to its rest position. However as shown in FIG. 19, if the period of the output signal of the sensor for detecting rotation of the driving motor is short (indicating that the print head is fast) there is not sufficient time for the impact pins to be retracted completely, reducing the quality of the subsequent printing impact.

Furthermore, use of existing impact print heads designed for printing on a cylindrical platen presents special problems when used to print on a platen with a different shape, such as a flat plane shaped platen found in some time recorders. FIGS. 12(*a*) and 12(*b*) show a print head having a plurality of pins "a" through "g" of a printing head B arranged in a line perpendicular to the length of the cylindrical platen A. The head shown has, by varying the angles of the printing pins, been designed to print on the curved surface of the cylindrical platen. Simultaneous operation of the pins, therefore, will produce impacts on the printed object P such as paper along the center line as shown in FIG. 12(*c*). The center line is referred to as the column direction and the head B scans in the row direction along the axis of the cylindrical platen A.

However, when the curved surface is replaced with one of a different shape such as the plane shaped platen D shown in FIGS. 13(*a*) and 13(*b*), simultaneous operation of the pins will instead produce the uneven "zig-zag" appearance shown in FIG. 13(*c*). Printing accuracy is deteriorated. Though a process of trial-and-error wherein the distance between the pins and time card C on the platen D are adjusted may improve the alignment of the impact positions somewhat, the result is generally unsatisfactory and the print quality is reduced. Redesigning the printing head to accommodate flat surfaces is undesirable because it is expensive, and the finished product will have the same disadvantage of being usable only for one type of platen.

Accordingly, there is still a need for a motor control method and an apparatus that overcomes the limitations of direct current motors in devices that feed and print cards to provide accurate speed and stop control without causing premature motor failure or transient speed variations.

There is also a need for a time recorder having a card feeder and an impact printing system incorporating the motor control apparatus that minimizes card feed time and allows printing on multiple platen shapes.

SUMMARY OF THE INVENTION

According to an embodiment of the invention, there is provided a motor control method for accurately stopping an object moved by a motor at a predetermined target position. The motor control method comprises the steps of driving the motor at a first predetermined speed until the object is a first predetermined distance from the predetermined target position and then carrying out primary braking to decelerate the motor to a second predetermined speed lower than the first desired speed. The motor is then driven at the lower speed until the object reaches a second predetermined distance from the target position. Secondary braking is then carried out to stop the object precisely at the target position. Thereby, the time period required for accurately stopping the object on target is minimized and the motor is accurately stopped.

In another embodiment the motor is temporarily stopped at midway in order to calculate the required first and second predetermined distances from the target position required to accurately stop an object at the target position.

In a further embodiment the driving speed of the motor is detected while primary braking is carried out. Thereby, the motor is accurately braked to the second predetermined speed.

In another embodiment, a motor control apparatus employing the motor control method of the invention is provided capable of stopping an object swiftly and accurately at a predetermined target position.

In a further embodiment, such a motor control apparatus is applied to a time recorder according to the invention in which a time card can be stopped accurately at a predetermined target position.

In another embodiment, shift amounts of impact positions of the respective printing pins in the row (horizontal) direction relative to a specific platen which is actually used when the plurality of printing pins are driven at the same timing, are previously stored to storing means, striking timings of the respective printing pins are controlled by controlling means based on a moving speed of the printing head in the row direction and the shift amounts of the impact positions of the respective printing pins in the row direction and accordingly, the impact positions of the printing pins can be aligned in a vertical arrangement. Therefore, deterioration in printing accuracy can be prevented, the deterioration being of the type caused in the case in which the printing operation is carried out by using a dot impact type printing head developed for a design platen with a specific platen having a shape different from the shape of the platen used. Further, general use performance of the dot impact type printing head developed for the design platen is enhanced. That is, the problem in which the dot impact type printing head developed for the design platen can be used only for the design platen is resolved.

In a further embodiment according to the invention, the motor is controlled such that the moving speed of the printing head in the row direction becomes a previously set predicted moving speed and the striking timings of the respective printing pins are controlled by the controlling means based on the predicted moving speed and the shift amounts of the impact positions of the respective printing pins in the row direction. By such a constitution, control of arranging the impact positions of the printing pins in the vertical arrangement can be facilitated. Therefore, there can be prevented the deterioration in the printing accuracy caused in the case in which the printing operation is carried out by using the dot impact type printing head developed for a design platen with the specific platen having a shape different from the shape of the platen used on the rear side of the printed object. Further, the general use performance of the dot impact type printing head developed for the design platen is enhanced. That is, the problem in which the dot impact type printing head developed for the design platen can be used only for the design platen is resolved.

In another embodiment, according to the invention, the striking timings of the respective printing pins are controlled by the controlling means based on a moving distance of the printing head in the row direction and the shift amounts of the impact positions of the respective printing pins in the row direction. By such a constitution, the problem similar to the above-described can be resolved and control of aligning the impact positions of the printing pins in the vertical arrangement can be facilitated with no necessity of calculating the moving speed of the printing head.

In a further embodiment, the striking duration time periods of the printing pins are controlled in accordance with the moving speed of the printing head in the row direction. In this way, the printing pins are driven for optimum striking duration time periods and the desired printing operation can be carried out even when the moving speed of the printing head in the row direction is changed by various factors of the motor. Therefore, there can be resolved the problem in which the operation successively proceeds to a next striking duration time period in a state in which the printing pin has not been pulled back to a set position, the printing pins cannot carry out correct ON and OFF operation and desired printing operation cannot be carried out.

Further, the striking duration time periods of the printing pins are stored in correspondence with the moving speed of the printing head in the row direction. In this way, the problem similar to the above-described problem can be resolved. The printing pins can be driven by reading the striking duration time periods immediately in accordance with the moving speed of the printing head in the row direction and accordingly, swift control is realized. That is, there can be resolved the problem of increasing a control time period caused in the case of calculating the striking duration time periods of the printing pins by, for example, a calculating operation.

Further, there is provided detecting means of the moving speed of the printing head in the row direction. In this way, a further swift control is realized.

Further, there is calculated the average value of the newest plurality of moving speeds detected by the speed detecting means and the striking duration time periods of the printing pins are controlled in accordance with the average value of the moving speeds. In this way, the printing pins can be controlled by further accurate striking duration time periods.

BRIEF DESCRIPTION OF THE DRAWINGS

FIGS. 12A, 12B and 12C are outline views of printing heads, a platen and positions of impact of printing pins according to a conventional example using a cylindrical platen;

FIG. 20 is an explanatory view showing a content of a time table for operation of the invention.

DESCRIPTION OF THE PREFERRED EMBODIMENTS

An explanation will be given of a case in which the apparatus of the invention is applied to a motor for a time recorder as an embodiment of a motor control method according to the invention as follows.

Figure 1:
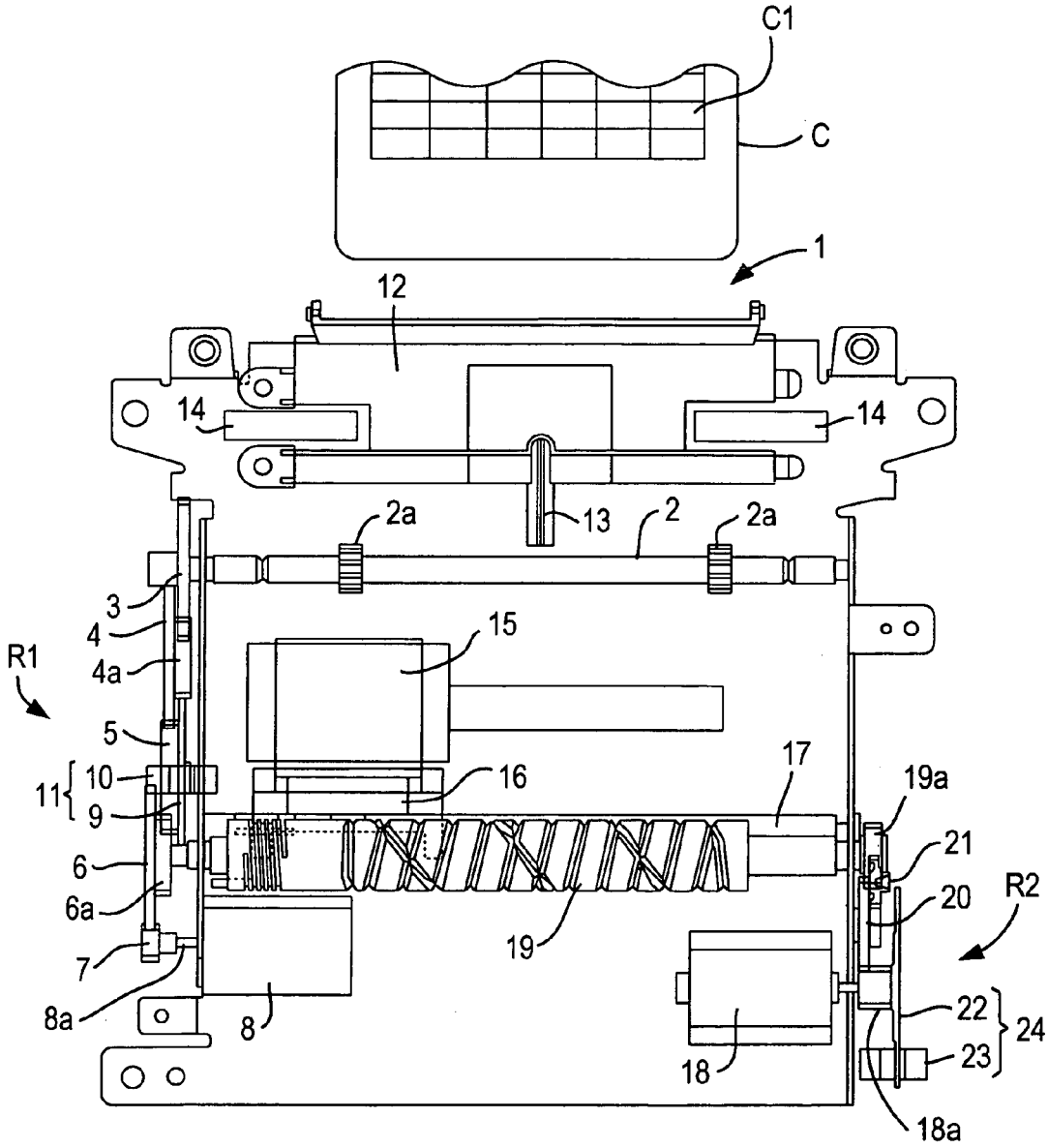
FIG. 1 is a front view showing an embodiment of an inner construction of a time recorder in accordance with the invention.

As shown by FIG. 1, a horizontally rotatable roller shaft 2 is provided near an upper portion of frame 1. The roller shaft 2 has pinch rollers 2*a*, 2*a* fixedly attached at positions in corresponding to both sides of a time card C. Rollers (not illustrated) paired with the pinch rollers 2*a*, 2*a* are rotatably provided on the opposite side of the time card C "pinch" time card C so that it can be moved in the up and down direction by forward and reverse rotation of the roller shaft 2. A wheel train R1 for moving the time card C in the up and down direction by transmitting rotation of a direct current motor (card feed motor) 8 to the roller shaft 2 is provided at a front left side portion of the frame 1.

A brief explanation will be given of the construction of the wheel train R1 by proceeding from the side of the roller shaft 2 to the drive side.

The roller shaft 2 is fixedly attached with a roller shaft drive gear 3 and a pinion 4*a* integral with a first intermediate wheel 4 which is in mesh with the drive gear 3. A second intermediate wheel 5 is in mesh with the first intermediate wheel 4 and a pinion 6*a* integral with a third intermediate wheel 6 which is further in mesh with the intermediate wheel 5. A motor gear 7 is fixedly attached to a motor shaft 8*a* of the card feed motor 8 attached to a lower portion of the frame 1. Therefore, by transmitting forward and reverse rotation of the card feed motor 8 to the roller shaft 2 via the wheel train R1, the time card C is transferred to draw in or out.

The second intermediate wheel 5 is integrally rotatably provided with a rotary plate encoder disc 9 concentric therewith. Through holes in a radial shape (not illustrated) are provided at equal intervals on an inner side of an outer peripheral portion of the encoder disc 9. An optical sensor 10 of an interrupter type is provided to sandwich the encoder disc 9 such that through holes pass or block light from the optical sensor 10 in accordance with rotation of the rotary encoder disc 9. Considered as a whole, detecting means (encoder) 11 for converting a rotation of the card feed motor 8 into a pulse signal is comprised of the encoder disc 9 and the sensor 10. A data signal outputted from the detecting means 11 is supplied to a control circuit 25, mentioned later.

A card slot 12 for receiving the time card C is provided near the upper portion of the frame 1, a card insertion detecting switch 13 is provided at the central portion of the card slot 12 and a pair of card sensors 14, 14 for constituting card detecting means for detecting respective card reference positions are provided at positions sandwiching both sides of the time card C.

A printing head 15 for printing day and time to a printing column Cl of the time card C is provided below the roller shaft 2. The printing head 15 is mounted to a carrier 16 and can be reciprocated in the horizontal direction (scanning direction of the printing head) along a guide post 17 by driving a carrier drive motor 18. A lead screw 19 rotatably supported by the frame 1 is provided at a vicinity of the guide post 17 and a wheel train R2 for transmitting rotation of the carrier drive motor 18 to the lead screw 19 is provided on the right side of the front face of the frame 1. According to the construction of the wheel train R2, a reduction gear 20 and a switch gear 21 are successively in mesh with a motor gear 18*a* of the motor 18 and a lead screw drive gear 19*a* fixedly attached to the lead screw 19 is in mesh with the switch gear 21. Therefore, by transmitting rotation of the carrier drive motor 18 to the lead screw 19 via the wheel train R2, the carrier 16 is moved and printing by the printing head 15 is enabled.

The motor gear 18*a* is integrally rotatably provided with an encoder disc 22 concentric therewith. Through holes in a radial shape (not illustrated) are provided at equal intervals on an inner side of an outer peripheral portion of the encoder disc 22. An optical sensor 23 of an interrupter type is provided to sandwich the encoder disc 22 such that the through holes pass or block light from the optical sensor 23 in accordance with rotation of the encoder disc 22. That is, detecting means (encoder) 24 for detecting rotation of the carrier drive motor 18 and calculating the moving speed of the carrier 16 for converting into the pulse signal comprises the rotary plate 22 and the optical sensor 23. A data signal outputted from the detecting means 24 is supplied to the control circuit 25 (FIG. 2) and controls the strike timing for each of the printing pins of the printing head 15 in accordance with the scanning speed of the head 15.

Therefore, when the time card C is inserted from the card insertion inlet 12, the card insertion detecting switch 13 detects the lower end portion of the time card C, the card feed motor 8 is actuated and the process of drawing in the time card C is started. When the card detecting means 14 detects the upper end portion of the time card C during the drawing operation, the card is stopped following the stop control procedure as explained later in detail.

Thereafter, the card feed motor 8 is reversed to thereby start the operation of pulling back the time card C to a predetermined target position. When the card detecting means 14 again detects the upper end portion of the time card C, the stop control procedure (explained later in detail) is initiated in time to bring the card to a stop at the predetermined target position.

When the time card C is stopped at the predetermined target position, the printing head 15 is scanned in the row direction (perpendicular to the length of the card) by actuating the carrier drive motor 18 and printing day and time to the printing column Cl of the time card C.

Figure 2:
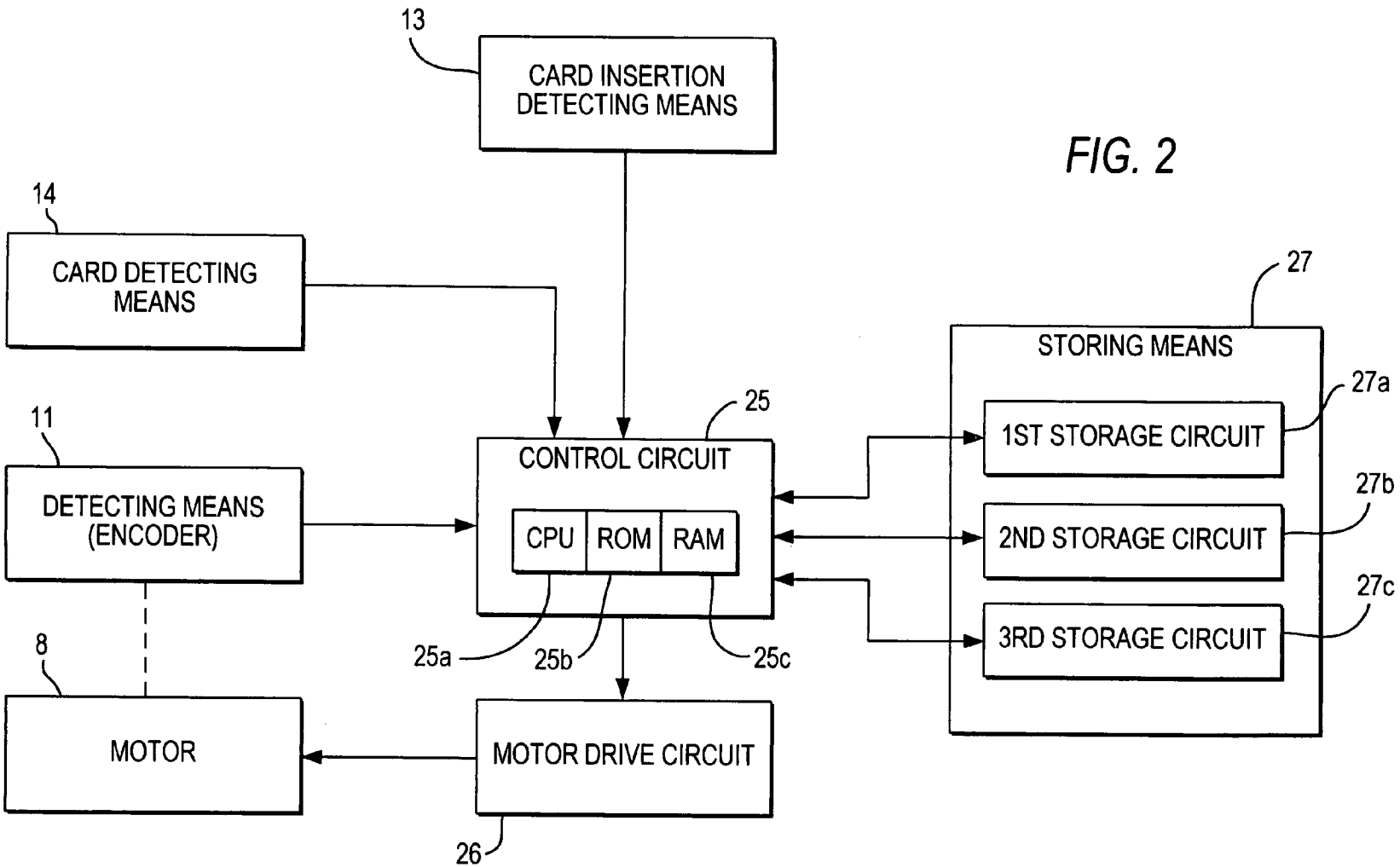
FIG. 2 is a block diagram showing an embodiment of the invention.

FIG. 2 is a block diagram showing the motor control apparatus of the present invention when configured for use in controlling motor 8 to provide accurate feeding of time card C. Output signals from the card insertion detecting means 13 and the card detecting means 14 can be inputted to the control circuit (CPU) 25 constituting a central pivotal portion of the motor control apparatus. The control circuit 25 is provided with CPU 25*a*, ROM 25*b* and RAM 25*c*. Further, the detecting means 11 is an encoder, mentioned above, which can measure the rotational speed of the motor 8 directly or indirectly and supply an output signal thereof to the control circuit 25.

Further, the control circuit 25 processes various data by CPU 25*a* in accordance with an operational program stored to ROM 25*b* and controls a motor drive circuit 26. Further, RAM 25*c* stores various data of a printing position and a printing content of the time card and stores a data from the detecting means (encoder) 11. The results of data collected from the encoder 11 are stored repeatedly in RAM 25*c* and are continuously updated by storing the latest measurement.

The control circuit 25 is provided with storing means 27 to store and recall data. The storing means 27 is provided with three storage circuits for storing motor control data, mentioned later.

First, a first storage circuit 27*a* stores information for driving the motor and is stored with two predetermined rotational speeds including a rotational speed for driving the motor 8 at a first desired speed (high speed) and a rotational speed for driving the motor 8 at a second predetermined speed (low speed) slower than the first desired speed. Therefore, by reading the first desired speed (high speed drive speed) or the second predetermined speed (low speed drive speed) from the first storage circuit 27*a* and supplying the first desired speed or the second predetermined speed to the motor drive circuit 26 by the control circuit 25, the motor 8 is rotated at a high speed or rotated at a low speed and the card C is transported at the high speed or the low speed respectively.

The second storage circuit 27*b* is stored with a speed s1 for driving the motor 8 at the second predetermined speed (low speed). Further, the speed s1 is read by the control circuit 25 and compared to the output from the encoder 11 stored to RAM 25*c*.

A third storage circuit 27*c* stores the position for applying primary braking during high speed drive, that is, a distance Ls from a predetermined target position corresponding to a first predetermined preliminary distance short of the target (the distance required in stop control, i.e. the distance required to stop a card through primary and secondary braking). Further, the third storage circuit 27*c* is stored with a position of applying secondary braking from low speed drive, that is, a distance Lb from the predetermined target position to a second predetermined position short of the target position defined by a second predetermined distance (stopping distance, defined as the distance required to stop from the low speed).

Figure 3:
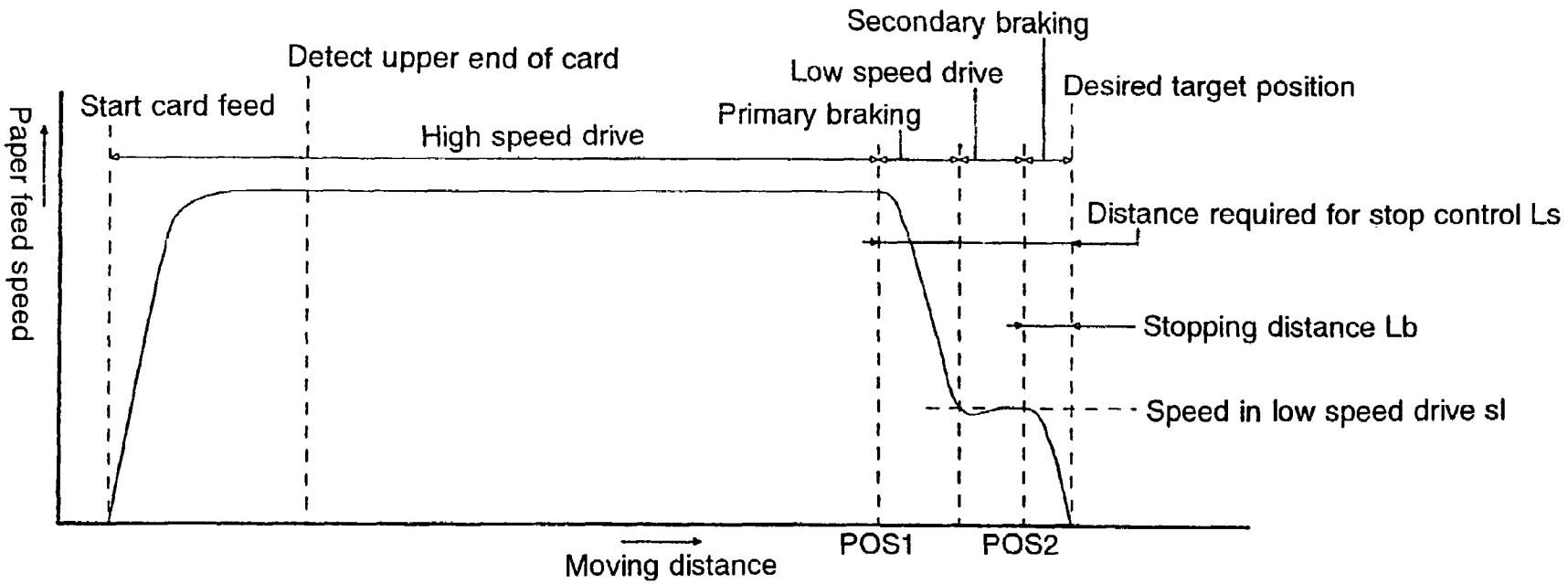
FIG. 3 is a diagram showing a relationship between a feed speed of a time card and a moving distance of the card for explaining stop control of feed of the time card according to the invention.

FIG. 3 shows a stop control diagram according to the invention in which the abscissa indicates a moving distance of a card, the ordinate indicates a card feed speed and a curve indicates a state of card feed control after finishing operation of drawing the card.

After having drawn the card, feeding the card to a predetermined target position is started by driving the card feed motor 8 at a high speed in a direction reverse to that in drawing the card. The predetermined target position is calculated by the control circuit 25 in accordance with day and time and is stored to a desired region of RAM 25*c*. When the upper end of the time card C is detected by the card detecting means 14, 14 during the operation of reversing the card into position, the position is set to a reference position as defined by actuation of the detecting means 14, 14 by the time card C.

Further, the feed distance of the time card is measured by counting a number of pulses of signal output of the sensor 10 of encoder 11 for detecting rotation of the motor 8. Further, the feed speed of the time card is calculated from the period of the signal output generated by sensor 10.

A position, POS1 of FIG. 3 is a position for applying primary braking and is a distance Ls short of the predetermined target position. Ls is stored to the third storage circuit 27*c* and is the distance required in stop control. When the time card reaches the POS1, primary braking is initiated to decelerate the motor 8 to the speed s1. The speed is stabilized when the motor 8 is driven at a low speed while monitoring the feed speed of the time card. During the operation of primary braking, the feed speed of the card is calculated by the encoder 11 and the control circuit 25 and is successively stored to RAM 25*c*. The control circuit 25 compares the speed provided by the encoder with the speed s1 read from the secondary storage circuit 27*b*. When the motor 8 is confirmed to have decelerated to the speed s1, primary braking is released, the speed s1 for low speed drive is read from the first storage circuit 27*a* and the motor 8 is switched to operate at low speed drive. Further, braking is applied by supplying a brake signal to the motor 8. Specifically, torque in the reverse direction is generated by counter electromotive force of the motor by short circuiting the motor 8. By the force of rotational inertia, the motor is overcome by the reverse torque creating a braking action. However, the method of braking is not limited to this approach, but may also consist of a drive pulse for generating the torque in the reverse direction applied to the motor or other methods of braking.

A position POS2 of FIG. 3 is a position for applying secondary braking at which the card C is short of the predetermined target position by the stop distance Lb (stored to third storage circuit 27*c*). When the time card reaches POS2, secondary brake control for stopping the time card is carried out to thereby stop the card at the predetermined target position.

According to this approach, before carrying out the secondary braking that actually stops the card, the card feed speed is decelerated and is stabilized. Further, the card feed speed is sufficiently decelerated to reduce errors caused by changes in temperature, variations in mechanical load or friction of the time card. The card feed speed before secondary braking is stabilized and accordingly, stabilized stop control can be carried out every time. Further, by carrying out primary braking, a time period for decelerating the card from high speed drive to low speed drive can be shortened as compared with that in the prior art and accordingly, the time period required for stop control can be shortened and high speed card feed can easily be accurately controlled.

Figure 4:
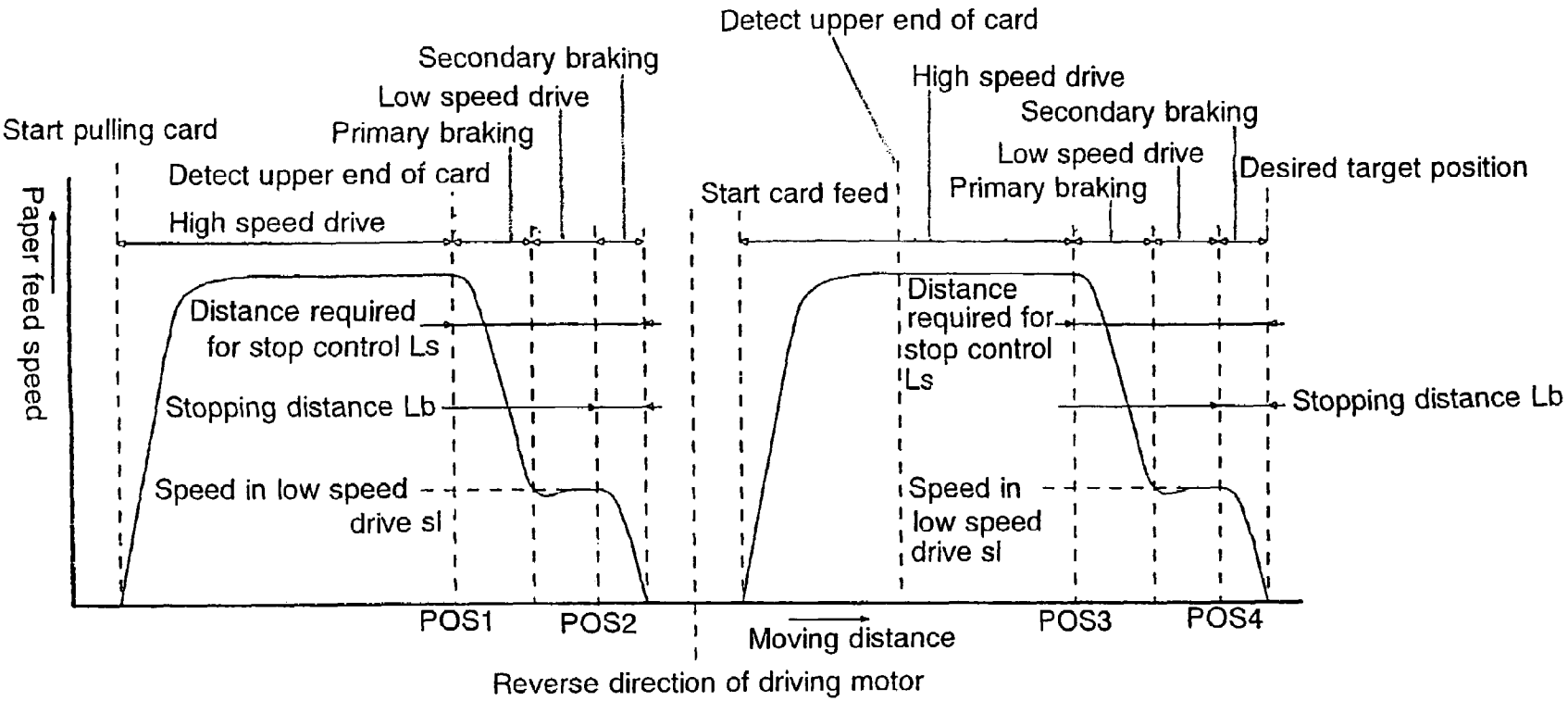
FIG. 4 is a diagram showing another example of stop control of feed of the time card according to the invention.
Figure 5:
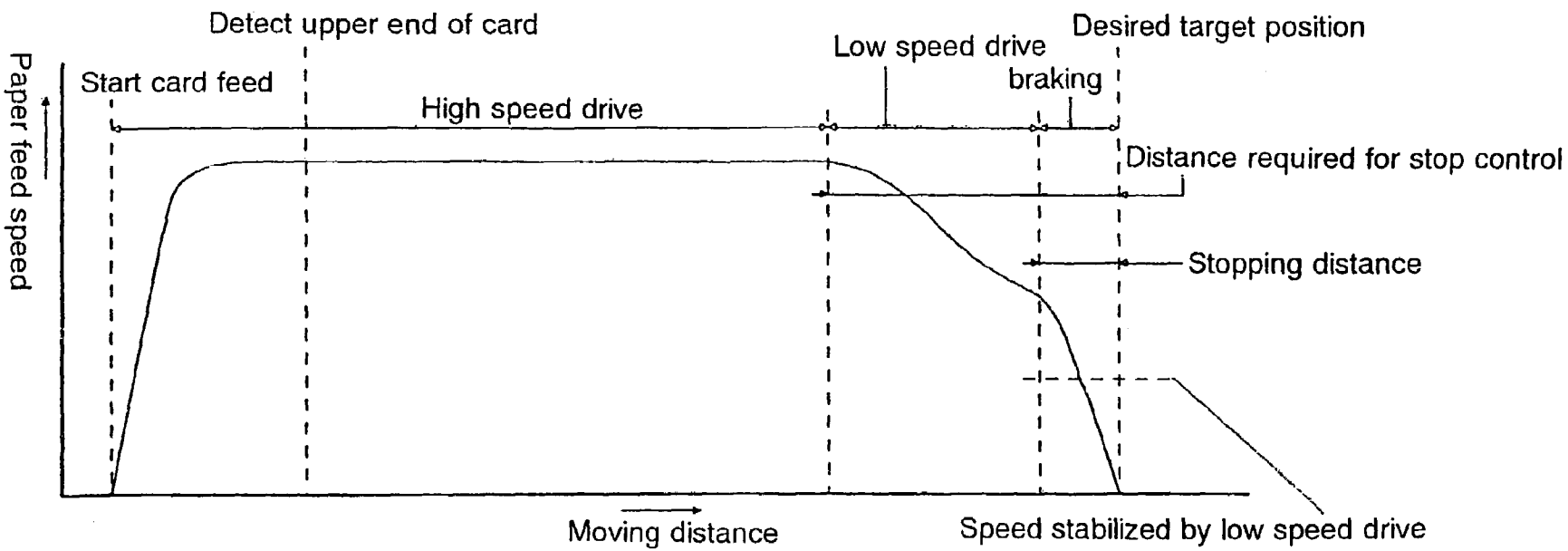
FIG. 5 is a diagram showing a relationship between the moving amount of the time card and rotational speed of a motor according to a conventional example.
Figure 6:
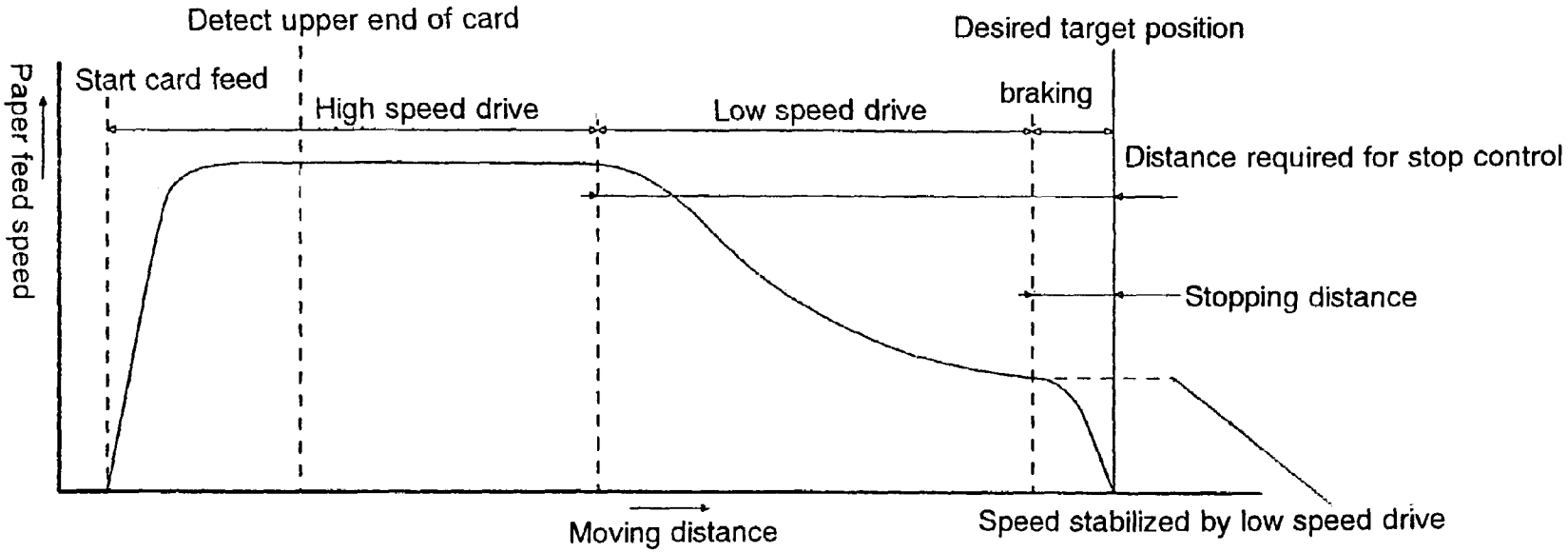
FIG. 6 is a diagram showing a relationship between the moving amount of the time card and the rotational speed of the motor according to another conventional example.

FIG. 4 shows another example of a stop control diagram according to the invention in which the abscissa indicates the moving distance of the card, the ordinate indicates the card feed speed and the curve indicates a state of control from the card drawing operation to the end of the card feeding operation. According to the example, after moving the time card C and before stopping the time card C at the predetermined target position, the card is temporarily stopped and a braking distance covered during the temporary stopping operation is calculated. When the card is moved again, the braking distance information is updated so that when the card C arrives at the target it will do so based on more recent stopping data.

That is, the card feed motor 8 is driven at a high speed to draw the card. When the card reaches the position of POS1 of FIG. 4, that is, a position where the upper end of the time card C is detected by the sensors 14, 14 (hereinafter, referred to as "reference" position), primary braking is carried out for decelerating to the speed s1 which is stabilized when the motor 8 is driven at a low speed while monitoring the feed speed of the time card C. When the feed speed is decelerated to the speed s1 using the above-described approach, primary braking is released and the motor 8 is switched to low speed drive at the speed s1. When the card is at position POS2 of FIG. 4, that is, the position at which the card drawing operation is stabilized at the low speed drive, the secondary braking control is carried out and the card drawing operation is finished by stopping the drive motor 8.

At this point, a distance Ls' required for stop control during the operation of temporarily stopping the time card C is stored to RAM 25*c* of the control circuit 25. In a preferred method of calculating Ls', the number of pulses outputted from the encoder 11 is calculated by the control circuit 25 during a time period from when the upper end of the time card C reaches the reference position in the card drawing operation to when the time card C is stopped and Ls' is calculated based on the count value. After finishing the card drawing operation, the difference is calculated between the above-described braking distance Ls' and a distance Ls" which has been measured previously by experiment (stored to the third storage circuit 27*c*), and the distance Ls or the distance Lb is corrected in the control circuit in accordance with the difference found in the expected and observed stopping distances. By employing this approach to correct for errors it is possible stop the card accurately at the predetermined target position. For example, when the braking distance Ls' is longer than the previously measured distance Ls", it is determined that the actual braking distance is longer than the braking distance expected. The distance Ls or the distance Lb is therefore corrected to be longer and when the braking distance Ls' is shorter than the previously measured distance Ls", it is determined that the actual braking distance is shorter than the braking distance expected. In this case, the distance Ls or the distance Lb is corrected to be shorter.

Next, after the card C has been drawn, feeding the card to the predetermined target position is started by driving the card feed motor 8 at a high speed in the direction reverse to that in drawing the card. When the upper end of the time card C is detected by the card detecting means 14 during the card pulling operation, the position is set as a reference position of the time card C.

At position POS3 of FIG. 4 primary braking is applied. This position is reached prior to the predetermined target position by the distance Ls required for stop control. When the position is reached, primary braking is carried out to decelerate the motor 8 to the speed s1. The speed is stabilized while the motor 8 is driven at a low speed and the feed speed of the time card is verified by monitoring. When the motor is decelerated to the speed s1 following the approach described above, braking is released and the motor 8 is switched to low speed drive.

At position POS4 of FIG. 4 secondary braking is applied. POS4 is short of the predetermined target position by the stopping distance Lb (distance corrected as described above). When secondary braking is carried out from the predetermined target position and when the position is reached, the secondary braking control for stopping the time card is carried out to thereby stop the motor at the predetermined target position.

Further, although in the above-described operation, the stop distance Lb, corrected as described above, is used from the distance Ls and the stop distance Lb, the invention is not limited thereto but the distance Ls corrected as described above may also be used. Further, both the distance Ls and the stop distance Lb may be corrected using the same procedure described above with reference to distance Ls".

According to the invention, before applying the secondary braking to stop the motor, the card feed speed is stabilized at the predetermined speed for low speed drive. After having been decelerated and stabilized and the card feed speed is low enough, the error caused by a change in temperature, a variation in mechanical load or friction of the time card is minimized. Further, the card drawing operation and the card feeding operation are both carried out by similar stopping control. By utilizing the error in the braking distance determined in drawing the card, the braking distance during card feeding is corrected. Accordingly, any error in stopping the card at the predetermined target position is eliminated and stabilized stopping control can be carried out each time. Further, by carrying out primary braking, the time period for decelerating the motor from high speed drive to low speed drive can be shortened and accordingly, the distance Ls required for the stopping control can be shortened and high speed card feeding in a short distance can easily be accomplished and controlled.

Further, the predetermined speed obtained by the primary braking operation may be the same as the subsequent desired speed for rotating the motor thereafter. In this case, in switching the drive speed, the drive speed can most easily be made the next desired speed.

Further, it should be understood that the present invention is not limited to a time recorder but is applicable to a general apparatus having a motor as a drive source. Similarly the recording medium need not limited to a time card. The invention is applicable to transfer of, for example, ordinary print paper, magnetic cards or IC cards.

According to the invention, the time period required for controlled stopping can be shortened and accordingly, high speed card feed is made feasible. Further, the card feed speed immediately before applying brake for stopping can be maintained constant and therefore the effects of a change in temperature, a variation in mechanical load or a friction of a time card can be minimized and the motor can be stopped accurately at the predetermined target position.

Figure 7:
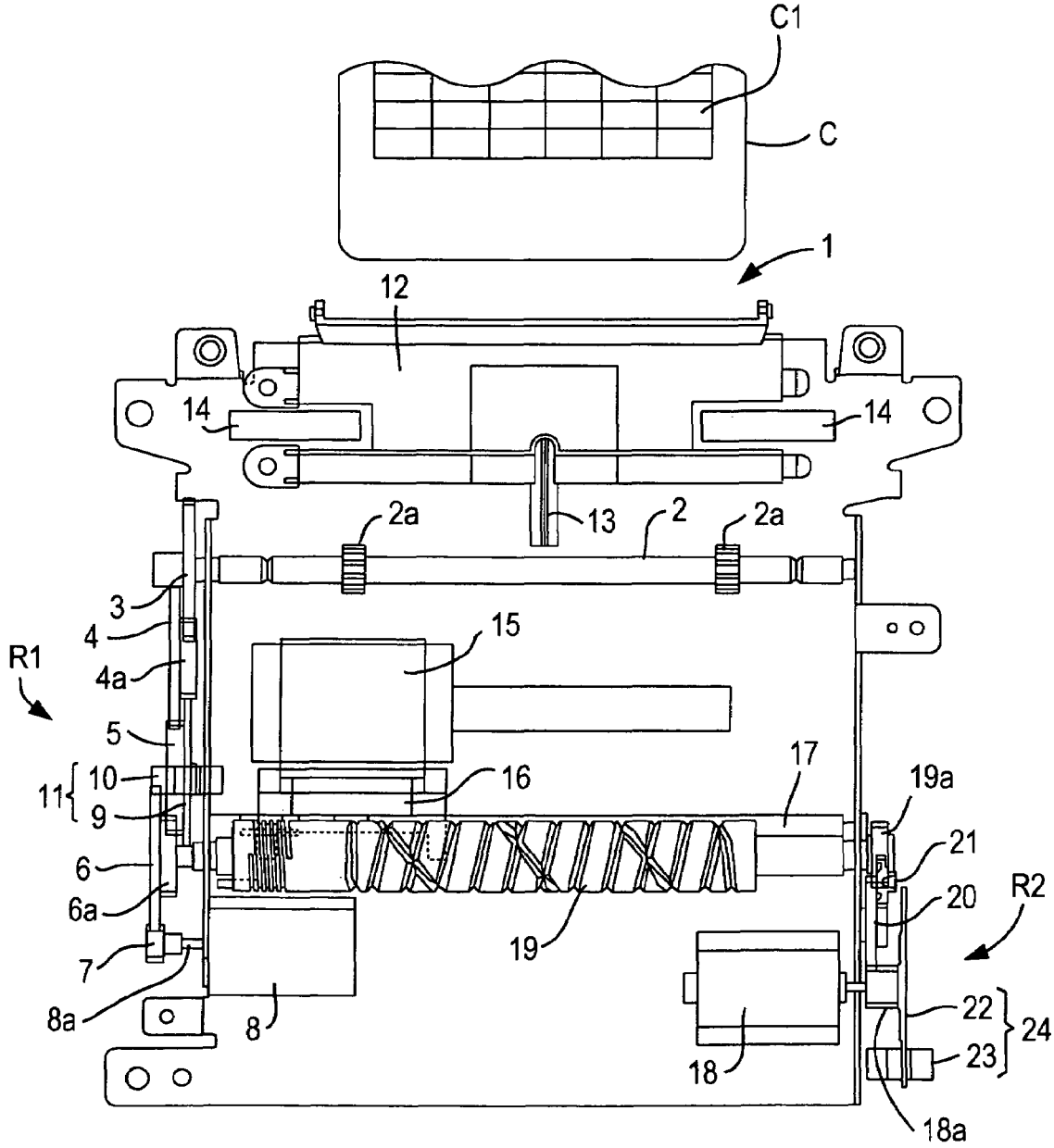
FIG. 7 is a front view showing an example of an inner construction of a time recorder in accordance with the invention.
Figure 8:
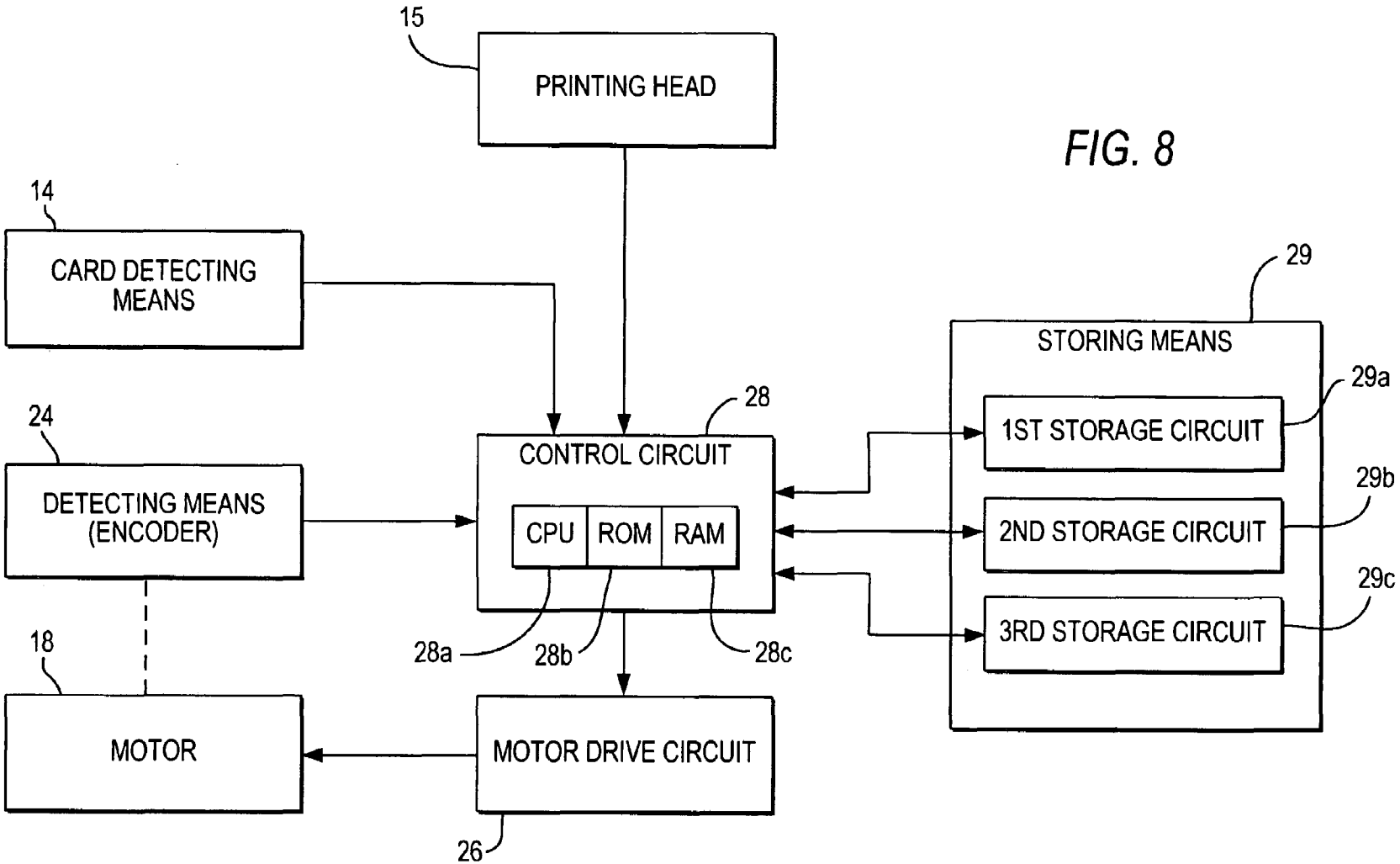
FIG. 8 is a block diagram showing an embodiment of the invention.

Another embodiment of the present invention is depicted in FIGS. 7 and 8 in which, like components are assigned like numerals.

Figures 13A, 13B, 13C:
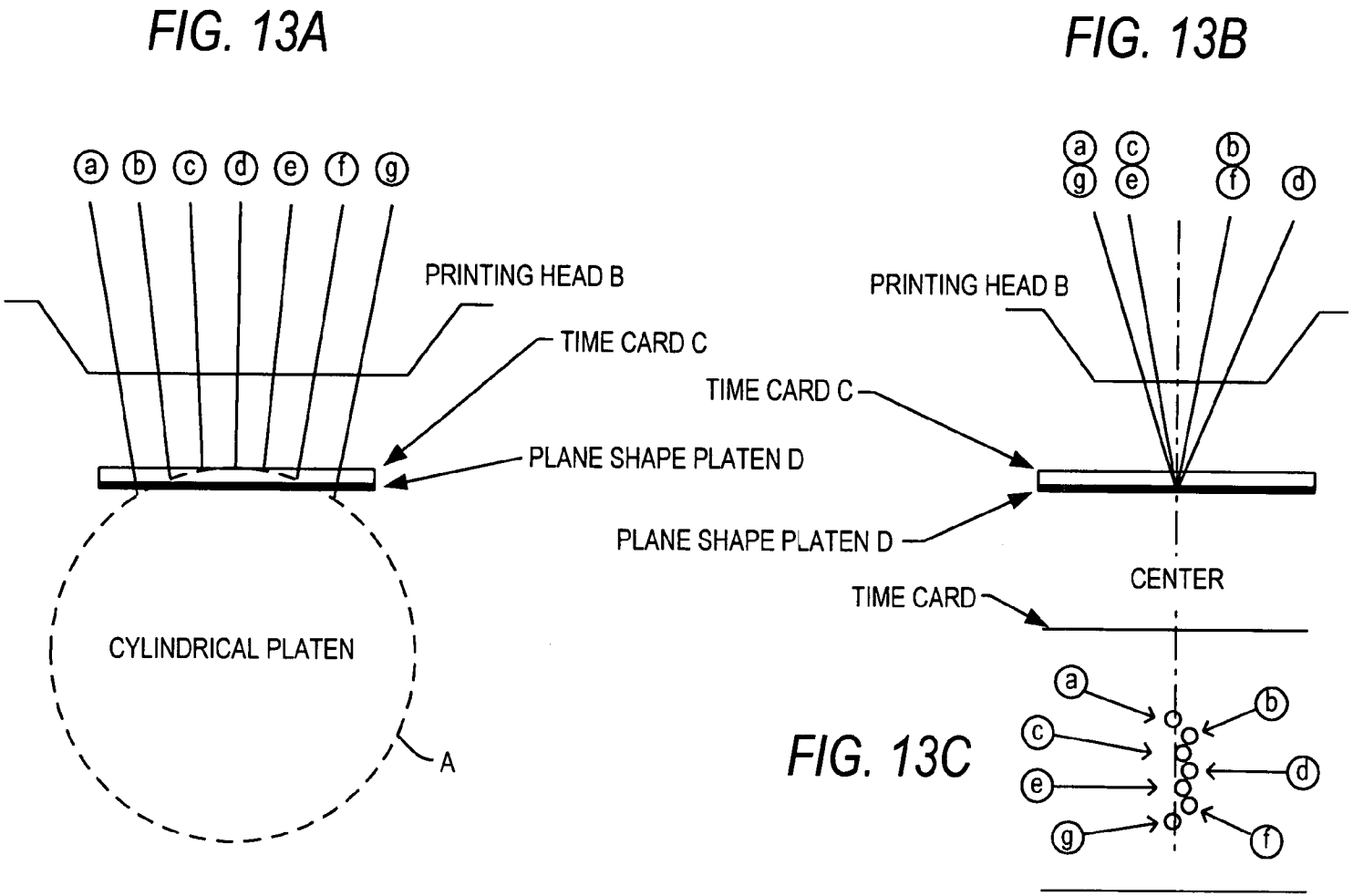
FIGS. 13A, 13B and 13C are outline views of a printing head, a platen and positions of impact of printing pins anticipated when printing is carried out by replacing the cylindrical platen according to the conventional example of FIGS. 12A, 12B and 12C by a flat plate type platen.

In FIG. 7, the printing head 15 is provided with a plurality of printing pins in a column direction (oriented parallel to the length of time card C) and as shown by FIGS. 12A, 12B and 12C, when the plurality of printing pins are driven at the same time onto a platen "A" having a predetermined shape for which the printing head was designed (hereafter known as the "design platen", a cylindrical type platen in this example), the arrangement at impact of the printing pins constitutes a straight line. According to the present invention, the printing operation is carried out with a specific platen (plane type platen in this example) D having a shape different from the design platen A as shown by FIGS. 13A, 13B and 13C and the printing head 15 is mounted to the carrier 16 and can be reciprocated in the horizontal direction perpendicular to the length of the time card C (scanning direction of printing head) along the guide post 17 by driving the carrier drive motor 18.

As shown by FIG. 8, the data signal outputted from the detecting means 24 is supplied to a control circuit 28 and the control circuit 28 controls strike timing for each of the printing pins of the printing head 15 in accordance with the moving speed of the carrier 16, that is, the moving speed in the row direction of the printing head 15.

When the time card C is inserted from the card insertion inlet 12, the card insertion detecting switch 13 detects the lower end portion of the time card C, the card feed motor 8 is started and the operation of drawing time the card C is started. During the drawing operation, when the card detecting means 14 detects the upper end portion of the time card C, stop control of the card is carried out.

Thereafter, the card feed motor 8 is started in the reversely rotating direction, the operation of pulling up the time card C to the target printing position is started. When the detecting means 14 detects again the upper end portion of the time card C, stop control is again carried out pulling up the time card C to the desired printing position with the position as the reference position of the time card C.

When the time card C is stopped at the target printing position, the carrier drive motor 18 is started and rotates the lead screw 19 via the motor gear 18*a*, the reduction gear 20, the switch gear 21 and the lead screw drive gear 19*a*. By rotation of the lead screw 19, the carrier 16 is moved in the horizontal direction along the guide post 17 and accordingly, the printing head 15 provided to the carrier 16 is scanned in the row (horizontal) direction. Print processing is then carried out as described below.

During print processing, the moving speed or the moving distance of the printing head 15 in the row direction is calculated by the control circuit 28 based on the output signal of the encoder 24 comprising the rotary plate 22 and the optical sensor 23 for detecting rotation of the carrier drive motor 18. Strike timing for each of the printing pins "a" through "g" of the printing head 15 is controlled in accordance with the moving speed or the moving distance in the row direction.

FIG. 8 is a block diagram showing an embodiment of the impact type printing apparatus in which the output signal from the card detecting means 14 can be inputted to the control circuit (CPU) 28. The control circuit 28 constitutes the core of the motor control apparatus and the drive signal for the printing pins is supplied therefrom to the printing head 15. The control circuit 28 is provided with CPU 28*a*, ROM 28*b* and RAM 28*c*. Further, the detecting means 24 is an encoder comprised by the encoder disc 22 and the optical sensor 23 for detecting rotation of the carrier drive motor 18. As output from the optical sensor 23, a signal of six pulses is provided and the carrier advances by 1.8 mm for one rotation of the carrier drive motor 18. By supplying the output from the optical sensor 23 to the control circuit 28 and measuring the period of the signal by the control circuit 28, the moving speed of the carrier 16 (printing head 15) is calculated. For the moving speed, an average value "t" of the moving speeds of the newest four pulses is calculated. The average value "t" is stored to a first storage circuit 29*a*, mentioned later, and accordingly, the first storage circuit 29*a* is always stored with the newest moving speed "t".

Further, the control circuit 28 can process various data by CPU 28*a* in accordance with an operational program stored to ROM 28*b* and can output the result to the motor drive circuit 26. Further, RAM 28*c* is stored with various data of the printing position or the printing content of the time card and stored with the detection result by the detecting means (encoder 24).

The control circuit 28 is provided with storing means 29 to be able to receive and transmit data. As in the previous embodiment of the control circuit the storing means 29 is provided with three storage circuits.

That is, the first storage circuit 29*a* is stored with the newest moving speed "t" of the carrier 16, mentioned above, and by reading the moving speed "t" from the first storage circuit 29*a* by the control circuit 28 and supplying the moving speed "t" to the motor drive circuit 26, the carrier drive motor 18 is driven to rotate.

Figure 9:
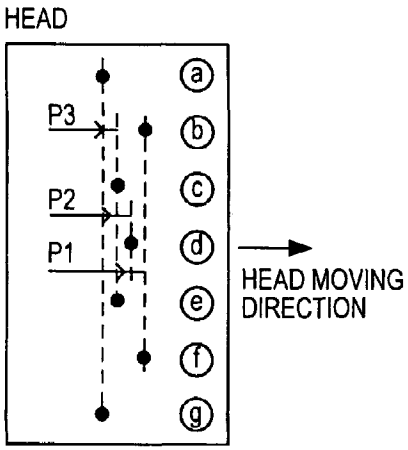
FIG. 9 is a view of positions of impact of printing pins by driving conventional printing pins.

A second storage circuit 29*b* is previously stored with shift distances P1, P2 and P3 in the row direction of positions of impact of the printing pins "a" through "g" shown by FIG. 13C and shown by FIG. 9. As mentioned later, the shift distances are values provided by measuring the impact shift distances previously by experiment.

Further, a third storage circuit 29*c* is stored with shift correction times P1*d*, P2*d* and P3*d* of the printing pins provided by dividing the shift distances in the row direction by the average value "t" of the moving speed of the carrier. As mentioned above, the average value "t" is always rewritten to the newest data and accordingly, the shift time of striking in correspondence with the shift distance is always rewritten to newest data.

A detailed explanation will be given of the shift distances P1 through P3 in the row direction of the impact positions of the printing pins in FIG. 9. As has been explained in reference to FIG. 12C and FIG. 13C, printing head 15 is designed to print a straight vertical column when the pins are driven simultaneously to a cylindrical platen "A". However, when the plurality of printing pins are driven onto the plane type platen "D" having a shape different from the shape of the cylindrical platen "A", the impact positions of the printing pins are not aligned vertically in one column neatly but are more or less shifted in the row direction as shown by FIG. 9. When the scanning direction of the printing head 15 is set to move to the right as shown by an arrow mark, the printing pins "b" and "f" hit the platen first, with the printing pin "d" hitting the platen later and therefore "d" prints to a position shifted from the initial impact position by the distance P1. Printing pins "c" and "e" hit next onto positions shifted by the distance P2 therefrom and pins "a" and "g" at a distance of P3 therefrom. Hence, the positions of impact can be aligned vertically in one column by retarding or advancing the firing of pins by time periods based on the distances P1, P2 and P3 and the scanning speed of the printing head 15 across the time card C. That is, time periods are provided by dividing the respective shift distances P1, P2 and P3 by the average value "t" of the moving speed. According to the example, the shift distances P1, P2 and P3 are previously measured and the results of measuring the distances are previously stored to the second storage circuit 29*b*.

Figure 10:
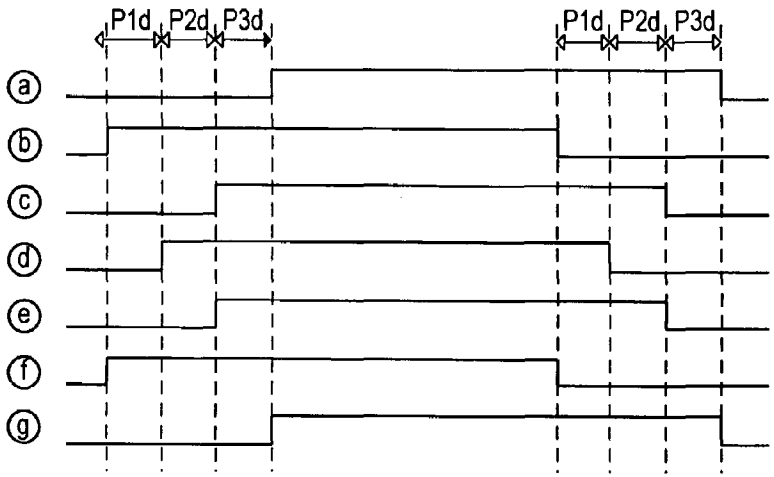
FIG. 10 illustrates timing charts of striking respective printing pins according to the invention.

FIG. 10 shows timings of striking respective printing pins in which the position of the carrier 16 is detected by the number of pulses of the optical sensor 23 and when the carrier reaches the target printing position, drive signals for the printing pins "b" and "f" are supplied first and striking operation is started. Next, a drive signal for the printing pin "d" is supplied and the printing pin "d" is struck at a time delayed by a time period of P1*d*. Next, drive signals for the printing pins "c" and "e" are supplied and the printing pins "c" and "e" are struck at time delayed by a time period of P2*d* from the end of P1*d*. Finally, the drive signals of the printing pins "a" and "g" are supplied and the printing pins "a" and "g" are struck at time delayed by a time period of P3*d* from the end of P2*d*. When all of the printing pins "a" through "g" finish striking, the printing pins "a" through "g" are pulled back in the same order and in the same manner.

Figure 11:
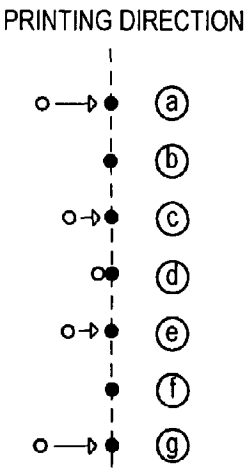
FIG. 11 is a view of the impact positions of printing pins by driving the printing pins according to the invention.

By carrying out such a printing control, as shown by the black circles of FIG. 11, printing results are accomplished in which impact positions of all of the printing pins "a" through "g" are aligned vertically in one column. Therefore, printing in a zigzag pattern as shown by FIG. 13C is improved and neat printing is realized. In actual printing operation, the printing pins "a" through "g" are selectively operated based on the above-described timings.

Further, by previously setting the moving speed of the printing head 15 in the row direction, storing the predicted moving speed to ROM 28*b* of the control circuit 28, detecting the moving speed of the printing head 15 from a signal provided by detecting rotation of the motor 18 by the encoder 24, comparing the predicted moving speed stored to ROM 28*b* with the moving speed of the printing head 15, correcting the moving speed of the printing head 15 by controlling voltage of the motor 18 such that the moving speed of the printing head 15 coincides with the predicted moving speed, by using the control circuit 28, thereafter, calculating striking shift time periods P1*d* through P3*d* by dividing the shift distances P1, P2 and P3 respectively by the predicted moving speed based on the predicted moving speed of the printing head stored to ROM 28*b* and the shift amounts P1, P2 and P3 for the respective printing pins stored to the storage circuit 29, a control of the striking timings for the respective printing pins may be carried out in accordance with the striking shift time periods P1*d* through P3*d*.

Still another embodiment is contemplated to bring about an output signal from the optical sensor 23 of the encoder 24 with greater precision such that, for example, the intervals among the through holes of the encoder disc 22 are made extremely small and more numerous to enable the control system to detect the rotation of the motor with higher accuracy and therefore calculate the moving distance of the printing head 15 with higher accuracy from the encoder output. That is, by counting the output signal from such a modified encoder, the moving distance of the printing head 15 can be estimated more precisely, and without resorting to calculations based upon the average scanning speed of printing head 15. The striking timings of the respective printing pins are directly controlled based on the detected moving distance and the above-described shift amounts of the respective printing pins. This means that the printing pins are selectively driven based on the condition that numbers of outputs of output signals from the optical sensor 23 correspond to the shift amounts P1, P2 and P3. In this case, after striking the printing pins "b" and "f", the printing head 15 advances by the distance of P1, and the printing pin "d" is struck, when the printing head 15 advances by the distance of P2, the printing pins "c" and "e" are struck, and finally, when the printing head advances by the distance of P3, the printing pins "a" and "g" are struck. The pins are pulled back in an order the same as that in the striking operation. In this example, the moving distance of the printing head can be used directly for controlling the striking timings of the respective printing pins with no necessity of calculating the moving speed of the printing head.

Further, although according to the above-described example, the design platen is the cylindrical platen and the specific platen is the flat plate shape platen, the invention is not limited thereto. For example, the design platen may be a cylindrical platen and the specific platen may be a cylindrical platen having a curvature different from that of the design platen. However, when the invention is used for a time recorder, a printing head for a cylindrical platen used in a normal printer can be applied to a plane platen of the time recorder and therefore, there can be resolved the problem in which a printing head exclusively for use in a time recorder must be used in order to obtain good print quality.

It should also be noted that although the number of the printing pins of the printing head is set to seven according to the above described embodiment, the number is not limited thereto but can be changed to accommodate printing heads with different numbers of pins.

Furthermore, although the preferred embodiment relates to use of the invention in a time recorder, the invention is not limited to the time recorder but is applicable to any desired printing apparatus.

According to the invention, the shift distances (amounts) in the row direction of the impact positions of the respective printing pins needed to align the printed output on the specific platen which is actually used are previously stored to the storing means. The striking timings of the respective printing pins are controlled by the controlling means based on the moving speed of the printing head in the row direction and the stored shift amounts. Therefore, the invention prevents a deterioration in printing accuracy caused in the case of printing onto a specific platen with a dot impact type printing head developed for a design platen with a different shape. In this way the present invention increases the usefulness of existing printing heads, in that they can be used to print on a wider variety of platen shapes without degrading print quality.

Further, according to the invention, the motor is controlled such that the moving speed of the printing head in the row direction becomes a previously set predicted moving speed and the striking timings of the respective printing pins are controlled by the controlling means based on the predicted moving speed and the shift amounts of the impact positions of the respective printing pins in the row direction. In such an embodiment, the control of aligning the impact positions of the printing pins vertically can be facilitated. Therefore, deterioration in the printing accuracy caused by printing with a dot impact type printing head developed for one platen on another platen having a different shape can be avoided. Further, overall performance of the dot impact type printing head developed for the design platen is enhanced in that it can be used in a greater variety of applications.

Furthermore, according to the invention, the strike timings of the respective printing pins may also be controlled by the controlling means based on the position of the printing head in the row direction and the shift amounts of the impact positions of the respective printing pins in the row direction. In such an embodiment, the problem of multiple platen printing can be resolved and further, the control of aligning the impact positions of the printing pins in a vertical arrangement can be facilitated without calculating the moving speed of the printing head.

Next, an explanation will be given of another embodiment in reference to FIGS. 14 and 15 wherein like parts are designated like notation.

Figure 14:
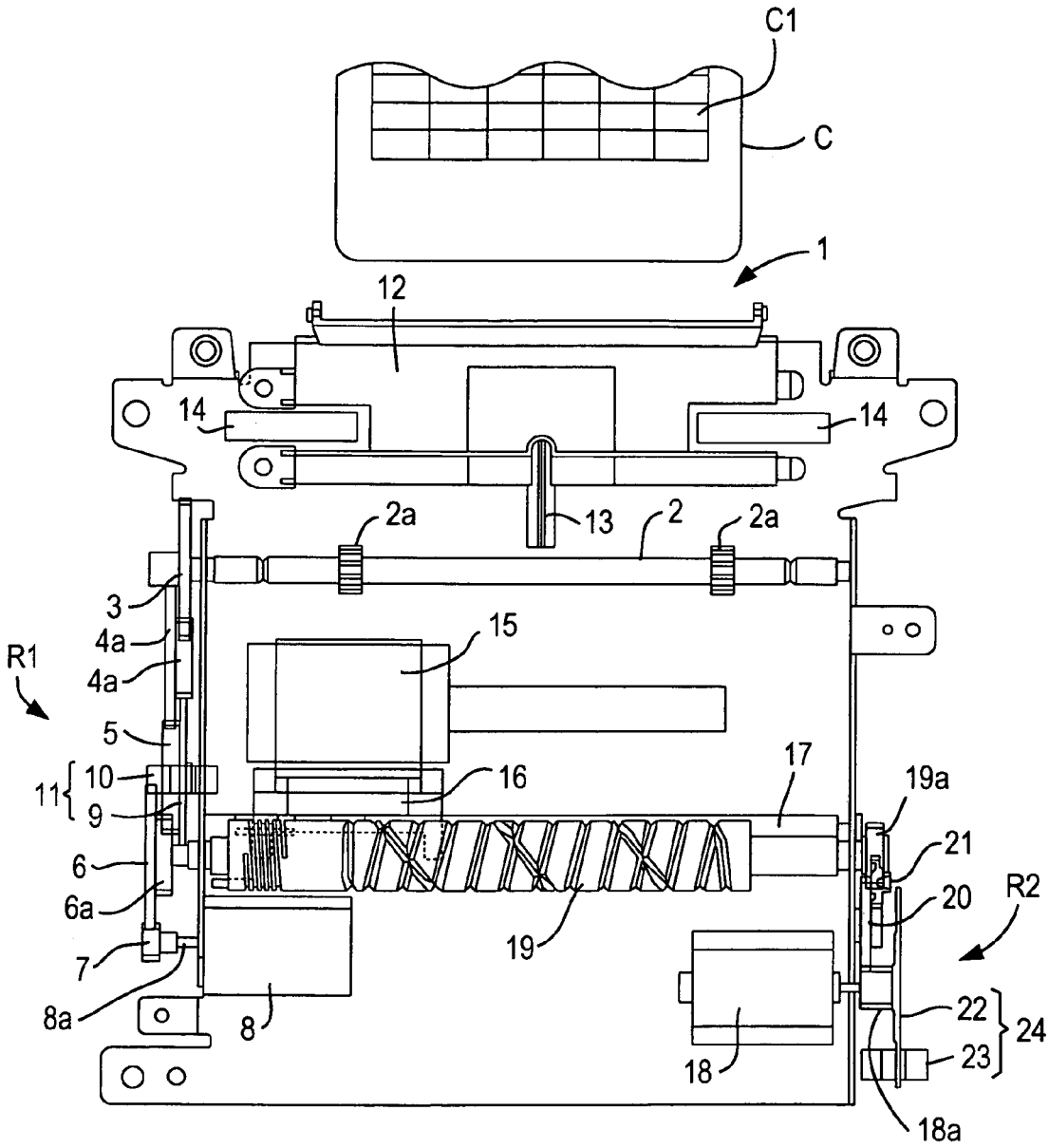
FIG. 14 is a front view showing an example of an inner construction of a time recorder in accordance with the invention.

In FIG. 14, the data signal outputted from the detecting means 24 is supplied to a control circuit 30 (FIG. 15), mentioned later, and the control circuit 30 constitutes speed detecting means for detecting the moving speed by processing the data signal.

When the time card C is inserted from the card insertion inlet 12, the card insertion detecting switch 13 detects the lower end portion of the time card C, the card feed motor 8 is actuated and the operation of drawing in the time card C is started. During the drawing operation, when the card detecting means 14 detects the upper end portion of the time card C, the card is brought to a controlled stop.

Thereafter, the operation of pulling up the time card C to the target printing position is started by actuating the card feed motor 8 in the reverse direction and when the card detecting means 14 detects again the upper end portion of the time card C, the controlled stopping of the time card C to the target printing position is carried out.

When the time card C is stopped at the target printing position, the carrier drive motor 18 starts driving to rotate the lead screw 19 via the motor gear 18*a*, the reduction gear 20, the switch gear 21 and the lead screw drive gear 19*a*. By rotation of the lead screw 19, the carrier 16 is moved in the horizontal (row) direction along the guide post 17 and therefore, the printing head 15 attached to the carrier 16 is scanned in the row direction in conformity with movement of the carrier and print processing is carried out, explained later in details to thereby print the day and time at the printing column C1 of the time card C.

During print processing, the moving speed of the printing head 15 is calculated by the speed detecting means (the control circuit 30) from the output signal from the encoder (detecting means) 24 comprised by the encoding disc 22 and the sensor 23 for detecting rotation of the carrier drive motor 18 and the striking duration time periods of the respective printing pins of the printing head 15 which are controlled in accordance with the moving speed.

Figure 15:
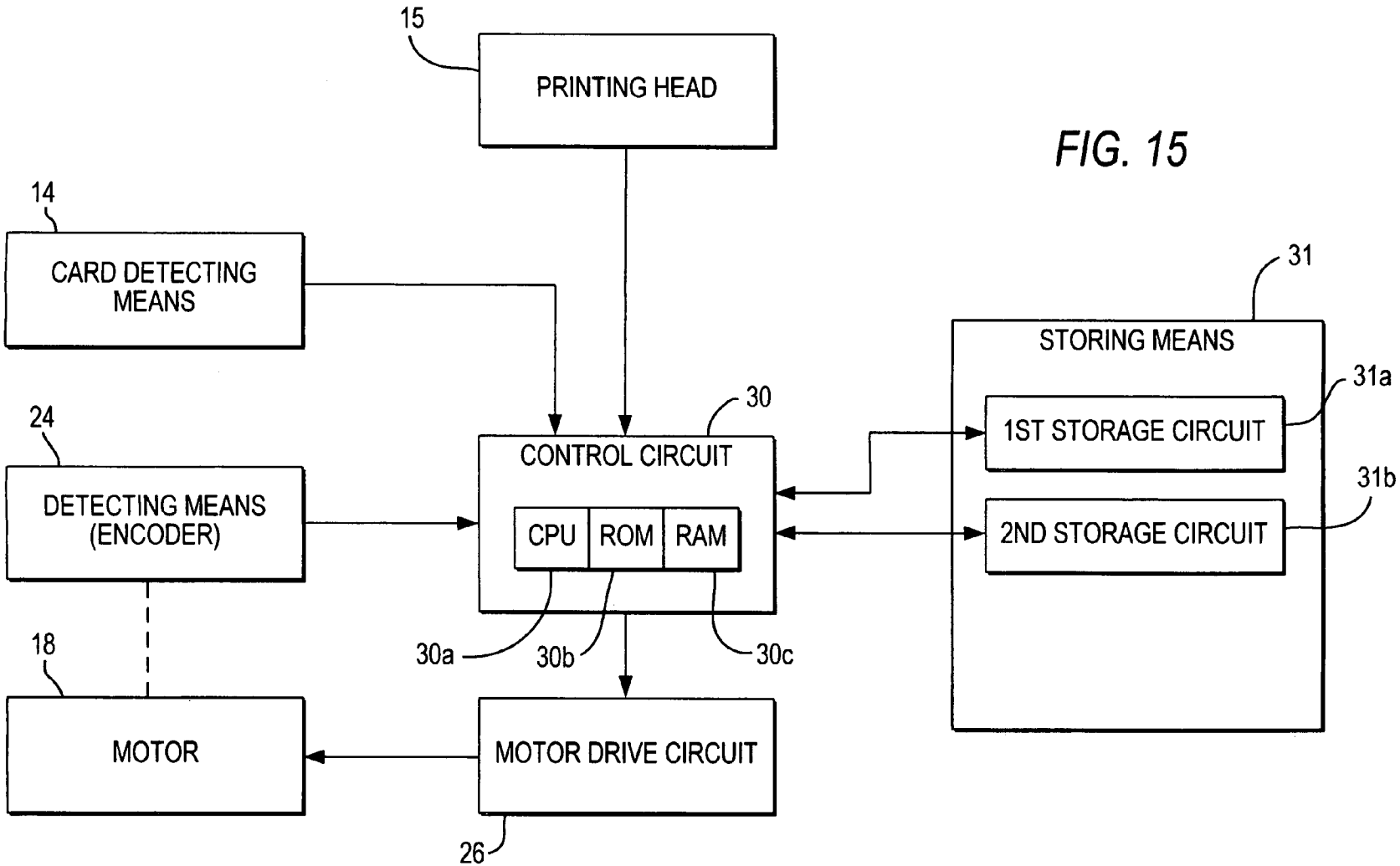
FIG. 15 is a block diagram showing an embodiment of the invention.

FIG. 15 is a block diagram showing an embodiment of an impact type printing apparatus in which the output signal from the card detecting means 14 can be inputted to the control circuit (CPU) 30. The control circuit 30 is the core of the motor control apparatus and supplies drive signals for printing pins to the printing head 15. The control circuit 30 is provided with CPU 30*a*, ROM 30*b* and RAM 30*c*. Further, the detecting means 24 is the encoder comprised by the encoding disc 22 and the sensor 23 for detecting rotation of the carrier drive motor 18. According to the output of the sensor 23, a signal of six pulses is provided each time the carrier advances by 1.8 mm for one rotation of the carrier drive motor 18. The output from the sensor 23 is supplied to the control circuit 30 and the moving speed of the carrier 16 (printing head 15) is calculated by detecting the period of the output signal at each time by the speed detecting means (the control circuit 30). The moving speed is updated at each time of inputting a new signal output from the sensor 23 and the average value "t" having the period of the newest four pulses is calculated.

According to the control circuit 30, various data is processed by CPU 30*a* in accordance with an operational program stored to ROM 30*b* and the result can be outputted to the motor drive circuit 26. Further, RAM 30*c* is stored with various data of the printing position and the printing content of the time card.

The control circuit 30 is provided with storing means 31 to be able to receive and transmit data. The storing means 31 is provided with two storage circuits.

A first storage circuit 31*a* is stored with a table of FIG. 20. FIG. 20 is a table formed by corresponding the most desirable striking duration time period POt(μs) of the printing pin, to a signal period (ps) calculated by the control circuit 30 from the output of the sensor 23 of the encoder 24, that is, a value in correspondence with the moving speed of the carrier 16. For example, when the moving speed falls in a range of 915 through 975 μs, the striking duration time period of 442 μs is selected as an optimum striking duration time period of the printing pin and when the moving speed falls in a range of 1159 through 1219 μs, the striking duration time period of 717 μs is selected as an optimum striking duration time period of the printing pin. By selecting such a striking duration time period, there remains a sufficient time period for making OFF the printing pin within the signal period and the printing pin can be pulled back to the correct position.

Further, a second storage circuit 31*b* is stored with the average value "t" of the period of the newest four pulses calculated by the control circuit 30. Further, by reading the moving speed "t" from the second storage circuit 31*b* and supplying the moving speed "t" to the motor drive circuit 26 by the control circuit 30, the carrier drive motor 18 is driven to rotate.

An example is given of printing numeral "8" in FIG. 17 as follows. With regard to a print start position, the print start position is detected by calculating the position of the carrier 16 by counting the number of pulses of the output signal of the sensor 23. As described above, the average value "t" of the newest signal period is calculated by the control circuit 30 and is stored to the second storage circuit 31*b*.

Figure 16:
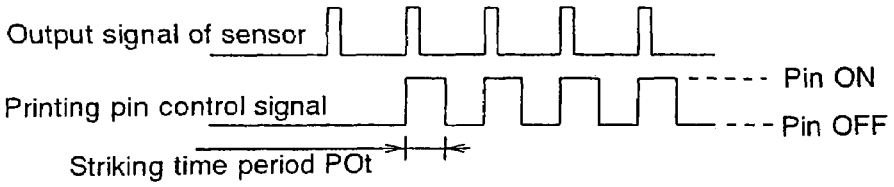
FIG. 16 illustrates waveform diagrams showing a relationship between a waveform of an output signal of a sensor and a waveform of a printing pin control signal according to the invention.

When the carrier 16 reaches the print start position, the striking duration time period POt of the printing pin is selected, corresponding to the average value "t" of the period of the sensor output signal shown in FIG. 16, from the data table of FIG. 20 stored to the first storage circuit 31*a*. Further, the printing pins in correspondence with printing data of a first vertical dot column shown by FIG. 17 are made ON by driving the printing pins for the striking duration time period POt and when the time period POt has elapsed, drive signals of the relevant printing pins are made OFF and the pins are pulled back.

Thereafter, when the carrier 16 is moved to reach a print start position of a second vertical dot column, the average value "t" of the period of the newest four pulses is recalculated at each pulse of the output signal from the sensor 23. The striking duration time period POt is calculated from the average value "t" of the period and as described above, the printing pins in correspondence with the printing data of the second vertical dot column are made ON by driving the printing pins for the striking duration time period POt and when the time period POt has elapsed, drive signals of the printing pins are made OFF and the pins are pulled back.

Figure 17:
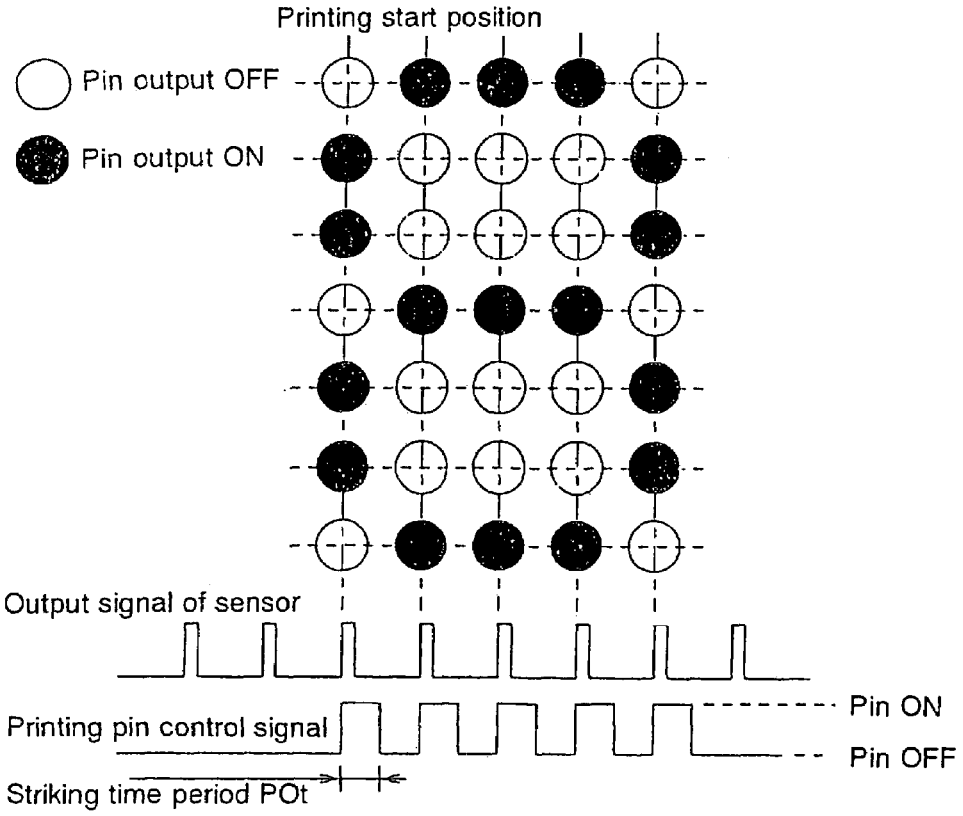
FIG. 17 is a view showing a relationship between a waveform of an output signal of a sensor and a waveform of a printing pin control signal in printing data according to the invention.
Figure 18:
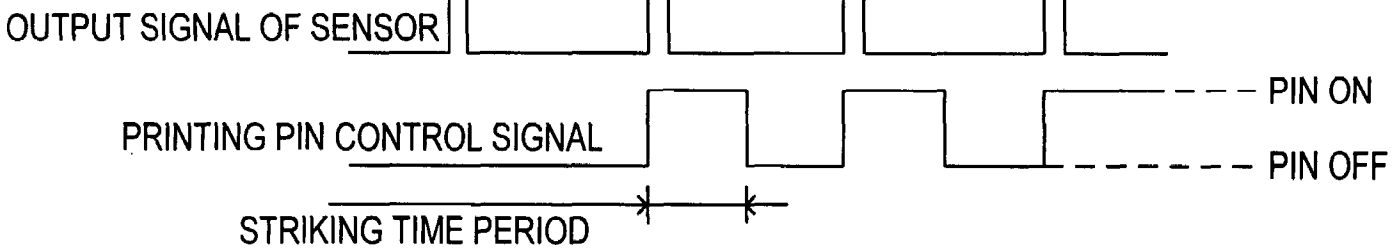
FIG. 18 illustrates waveform diagrams showing a relationship between a waveform of an output signal of a sensor and a waveform of a printing pin control signal according to a conventional example.
Figure 19:
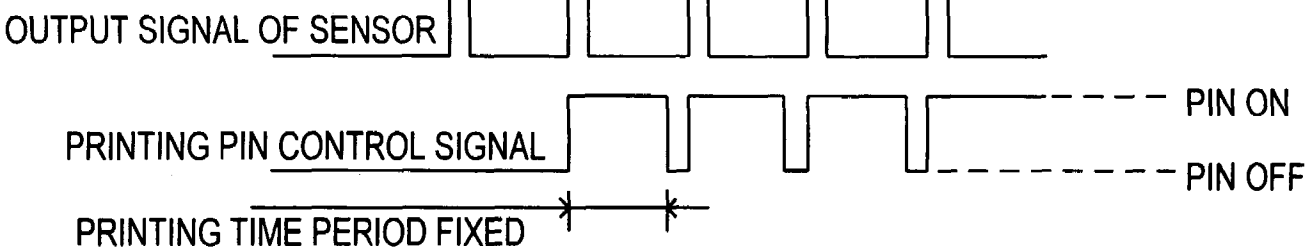
FIG. 19 illustrates waveform diagrams showing a relationship between a waveform of an output signal of a sensor and a waveform of a printing pin control signal according to another conventional example.

The operation is repeated, the printing pins corresponding to respective printing data from a third vertical dot column to a fifth vertical dot column, are made ON by driving the printing pins for the respective striking duration time periods POt and when the time periods POt have elapsed, the drive signals of the relevant printing pins are made OFF and the pins are pulled back to thereby finish printing the numeral "8" shown by FIG. 17.

In this way, by making the striking time periods POt of the printing pins in conformity to the newest average value "t" of the moving speed of the carrier, even when there is a nonuniformity in the rotational speed of the carrier drive motor 18, the printing pins can always provide sufficient printing darkness and sufficient time to pull back the printing pins.

Although the present embodiment has primarily been shown as part of a time recording apparatus, the use of the invention is not limited thereto, but is applicable to a variety of printing applications.

Further, although the time table of FIG. 20 is a time table showing a relationship between the signal period of the sensor 23 which is a value in correspondence with the moving speed of the carrier and the striking duration time period of the printing pin, the time table may be a table showing a relationship between the moving speed of the carrier and the striking duration time period of the printing pin. In this case, the moving speed of the carrier may be calculated from the signal period of the sensor 23 by the control circuit 30 and the striking duration time period of the printing pin may be calculated from the calculated moving speed.

According to the invention, the striking duration time period of the printing pin is controlled in accordance with the moving speed of the printing head in the tow direction. In this way, desired printing operation is carried out by driving the printing pins for the optimum striking duration time periods even in the case in which the moving speed of the printing head in the row direction is changed by various factors of the motor. There can be resolved the problem in which the operation successively proceeds to a next striking duration time period in a state in which the printing pin has not been pulled back to a set position, the printing pin cannot carry out correct ON and OFF operation and desired printing operation cannot be carried out.

Further, the striking duration time period of the printing pin is stored to correspond to the moving speed of the printing head in the row direction. In this way, the problem similar to the above-described can be resolved and further, the printing pin can be driven by reading the striking duration time period immediately in accordance with the moving speed of the printing head in the row direction and accordingly, speed control is realized. That is, there can be resolved the problem of increasing a control time period caused in the case in which the striking duration time period of the printing pin is calculated by, for example, a calculating operation.

Further, there is provided the detecting means for detecting the moving speed of the printing head in the row direction. In this way, a further speed control is realized.

Further, there is calculated the average value of the newest ones of a plurality of the moving speeds detected by the speed detecting means and the striking duration time period of the printing pin is controlled in accordance with the average value of the moving speed. In this way, the printing pin can be controlled by a further accurate striking duration time period.

What is claimed is:

1. An impact type printing apparatus comprising:

a printing head having a plurality of aligned printing pins adapted to strike a design platen having a predetermined shape;

a platen, proximal to the printing surface of the printing head, said platen having a surface of a shape other than said predetermined shape;

a motor connected to said head to provide scanning in a linear direction along said platen surface;

motor controlling means for controlling the motor to provide constant scanning speed; and print controlling means for carrying out a printing operation during the scanning of the head, said print controlling means configured to provide printing pin actuation timing correction dependent upon said scanning speed and said platen shape.

2. The impact type printing apparatus according to claim 1 wherein the design platen is a cylindrical platen and said platen is a flat plate platen.

3. The impact type printing apparatus according to claim 1 wherein said motor provides scanning of said head in the row direction.

4. An impact type printing apparatus comprising:

a printing head having a plurality of printing pins;

a scanning mechanism for scanning the printing head along a single axis;

a motor for driving the scanning mechanism to permit printing while scanning;

a controlling means to modify striking duration time periods of the printing pins in accordance with the scanning rate; and a speed detecting means connected to the motor for detecting and transmitting the scanning rate of the scanning mechanism to the controlling means, wherein the controlling means continually updates an average of the newest plurality of the moving speeds detected by the speed detecting means, and controls the striking duration time periods according to the average value of the moving speeds.

* * * * *